US008905252B2

(12) United States Patent
Latham et al.

(10) Patent No.: US 8,905,252 B2
(45) Date of Patent: Dec. 9, 2014

(54) DRINK CONTAINERS WITH CLOSURE RETENTION MECHANISMS

(71) Applicant: CamelBak Products, LLC, Petaluma, CA (US)

(72) Inventors: Matthew W. Latham, Dixon, CA (US); Derek Gavin Sullivan, Oakland, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 14/199,817

(22) Filed: Mar. 6, 2014

(65) Prior Publication Data

US 2014/0263324 A1 Sep. 18, 2014

Related U.S. Application Data

(60) Provisional application No. 61/779,084, filed on Mar. 13, 2013, provisional application No. 61/859,662, filed on Jul. 29, 2013.

(51) Int. Cl.
*B65D 51/18* (2006.01)
*B65D 55/16* (2006.01)

(52) U.S. Cl.
CPC ..... *B65D 51/18* (2013.01); *B65D 55/16* (2013.01)
USPC ..... 215/306; 215/228; 220/212.5

(58) Field of Classification Search
CPC .. B65D 23/108; B65D 23/104; B65D 23/102; B65D 23/10; B65D 55/16; B65D 51/18; B65D 41/26; B65D 39/16; B65D 2543/00833; B65D 25/2826; B65D 25/2802; B65D 25/28
USPC ..... 215/306, 228, 396, 395, 356, 355; 220/212.5, 212, 254.8, 254.3, 254.1, 220/375, 789, 780, 801, 756, 836, 810; 222/469, 470, 473, 472, 556, 562, 563, 222/568, 567
See application file for complete search history.

(56) References Cited

U.S. PATENT DOCUMENTS 2,117,407 A 5/1938 Davis
D133,978 S 10/1942 Johnson
(Continued)

FOREIGN PATENT DOCUMENTS

WO WO 2012/095491 7/2012

OTHER PUBLICATIONS

Crestline. "Halo Water Bottle". Wayback Machine, http://www.crestline.com/halot-water-bottle-9452.aspx, Jan. 16, 2011, p. 1.*

*Primary Examiner* — Robert J Hicks
(74) *Attorney, Agent, or Firm* — DASCENZO Intellectual Property Law, P.C.

(57) ABSTRACT

Drink containers include a liquid container and a cap assembly removably coupled to the liquid container. Cap assemblies include a base, a drink spout extending from the base, a closure configured to be removably coupled relative to the drink spout in a closed position to selectively restrict dispensing of drink liquid through the drink spout and to selectively permit dispensing of drink liquid through the drink spout when removed from the drink spout. Cap assemblies further may include a handle extending from the base and configured to selectively retain the closure in a stowed position when the closure is selectively removed from the drink spout. In some embodiments, the handle defines a closed perimeter and the closure is received within the closed perimeter when positioned in the stowed position. Some embodiments further include a tether that couples the closure to the cap assembly or to the liquid container.

20 Claims, 7 Drawing Sheets

(56) References Cited

U.S. PATENT DOCUMENTS

| | | | |
|---|---|---|---|
| 2,549,225 | A | 4/1951 | Moy |
| 2,588,275 | A | 3/1952 | Nadai |
| 2,962,185 | A | 11/1960 | Starr et al. |
| 3,181,725 | A | 5/1965 | Friedl |
| 3,307,752 | A | 3/1967 | Anderson |
| 3,944,104 | A | 3/1976 | Watson et al. |
| 4,265,363 | A | 5/1981 | Conn |
| 4,711,365 | A | 12/1987 | Fomby |
| D319,981 | S | 9/1991 | Sledge |
| 5,044,512 | A | 9/1991 | Giancaspro et al. |
| 5,207,341 | A | 5/1993 | Yeager |
| 5,244,106 | A | 9/1993 | Takacs |
| D368,032 | S | 3/1996 | Couto |
| 5,597,082 | A | 1/1997 | Luch et al. |
| D399,744 | S | 10/1998 | Gross |
| 5,947,310 | A | 9/1999 | Wagner |
| 6,032,829 | A | 3/2000 | Geisinger et al. |
| 6,079,589 | A | 6/2000 | Matsuyama et al. |
| 6,112,926 | A | 9/2000 | Fishman |
| 6,131,755 | A | 10/2000 | Soyka, Jr. et al. |
| 6,230,944 | B1 | 5/2001 | Castellano et al. |
| D457,779 | S | 5/2002 | Gullickson et al. |
| D471,808 | S | 3/2003 | de Castro Couto |
| 6,648,158 | B1 | 11/2003 | Lawrence |
| 6,675,998 | B2 | 1/2004 | Forsman et al. |
| D489,613 | S | 5/2004 | Campbell et al. |
| 7,014,077 | B2 | 3/2006 | Brown |
| D547,607 | S | 7/2007 | Forsman |
| D565,353 | S | 4/2008 | Roth et al. |
| 7,448,509 | B2 | 11/2008 | Yang |
| D586,184 | S | 2/2009 | Miller et al. |
| D592,913 | S | 5/2009 | Pinelli et al. |
| 7,533,783 | B2 | 5/2009 | Choi et al. |
| D605,942 | S | 12/2009 | Miksovsky |
| D612,731 | S | 3/2010 | Bragg |
| D614,440 | S | 4/2010 | Cresswell et al. |
| 7,753,240 | B2 | 7/2010 | Leoncavallo et al. |
| D626,837 | S | 11/2010 | Meyers et al. |
| D626,838 | S | 11/2010 | Meyers et al. |
| 7,866,183 | B2 | 1/2011 | Roth et al. |
| 7,870,968 | B2 | 1/2011 | Hanson |
| D634,161 | S | 3/2011 | Roth et al. |
| D636,671 | S | 4/2011 | Lohrman et al. |
| D640,093 | S | 6/2011 | Picozza et al. |
| D641,623 | S | 7/2011 | Fields |
| 7,980,403 | B2 | 7/2011 | Martinez |
| D643,718 | S | 8/2011 | Fields |
| 8,051,997 | B2 | 11/2011 | Buckley |
| D649,879 | S | 12/2011 | Gullickson et al. |
| D652,256 | S | 1/2012 | Eyal |
| D654,793 | S | 2/2012 | Rosbach |
| D657,618 | S | 4/2012 | Wahl |
| D657,994 | S | 4/2012 | Wahl et al. |
| 8,191,727 | B2 | 6/2012 | Davies et al. |
| 8,245,870 | B2 | 8/2012 | McKinney et al. |
| D669,310 | S | 10/2012 | Barreto et al. |
| 8,328,037 | B2 | 12/2012 | Wu |
| 8,371,244 | B2 | 2/2013 | Krasner |
| D678,717 | S | 3/2013 | Yasui |
| D679,541 | S | 4/2013 | Samartgis |
| D682,034 | S | 5/2013 | El-Saden et al. |
| 8,443,993 | B1 | 5/2013 | Desselle |
| 8,443,994 | B1 | 5/2013 | Desselle |
| D683,581 | S | 6/2013 | Archer |
| 8,469,226 | B2 | 6/2013 | Davies et al. |
| 2005/0011897 | A1 | 1/2005 | Stuart |
| 2005/0274741 | A1 | 12/2005 | Cho |
| 2007/0039959 | A1 | 2/2007 | Choi et al. |
| 2008/0017642 | A1 | 1/2008 | King |
| 2008/0087624 | A1 | 4/2008 | Buckley |
| 2008/0142466 | A1 | 6/2008 | Balitski |
| 2009/0152231 | A1 | 6/2009 | Hanson |
| 2009/0236341 | A1 | 9/2009 | Mckinney et al. |
| 2009/0250426 | A1 | 10/2009 | Martinez |
| 2010/0181329 | A1 | 7/2010 | Davies et al. |
| 2011/0127232 | A1 | 6/2011 | Willows et al. |
| 2011/0174993 | A1 | 7/2011 | Blain |
| 2011/0284541 | A1 | 11/2011 | Webster et al. |
| 2012/0145713 | A1 | 6/2012 | Jung |
| 2012/0298614 | A1 | 11/2012 | Nelson |

* cited by examiner

DRINK CONTAINERS WITH CLOSURE RETENTION MECHANISMS

RELATED APPLICATIONS

This application claims priority under 35 U.S.C. §119(e) to U.S. Provisional Patent Application No. 61/779,084, which is entitled "DRINK CONTAINERS WITH CLOSURE STORAGE MECHANISMS" and was filed on Mar. 13, 2013, and to U.S. Provisional Patent Application No. 61/859,662, which is entitled "DRINK CONTAINERS WITH CLOSURE STORAGE MECHANISMS" and was filed on Jul. 29, 2013, the disclosures of which are hereby incorporated by reference.

FIELD

The present disclosure relates to drink containers, and more particularly to portable drink containers with at least a drink spout that is selectively sealed by a closure.

BACKGROUND

For some time, people have recognized the need to stay hydrated. Conventionally, many individuals carry drink containers that hold water or other potable beverages. These drink containers typically include a bottle that is formed from plastic or metal. These containers also frequently include a cap, which is removably secured to a neck or other opening of the bottle. Some bottles include a threaded neck from which a user drinks liquid contained in the bottle after removal of the cap. In some conventional drink containers, the cap is tethered to the bottle so that upon removal of the cap, the cap does not become lost, misplaced, or otherwise separated from the bottle. Illustrative, non-exclusive examples of such drink containers include a threaded cap that is tethered to the neck of the container. Some conventional drink containers include a drink spout, or nozzle, that is integral with the cap and from which liquid may be drawn from the drink bottle without removal of the cap from the bottle. Illustrative, non-exclusive examples of such drink containers include squeezable drink containers with push-pull drink spouts and CAMELBAK® brand drink containers with bite-actuated mouthpieces.

SUMMARY

Drink containers and associated cap assemblies are disclosed herein. Drink containers according to the present disclosure include at least a liquid container and a cap assembly. The liquid container has a neck with an opening and an internal compartment sized to hold a volume of potable drink liquid. The cap assembly includes a base, a drink spout, and a closure. The base is removably coupled to the neck of the liquid container. The drink spout extends from the base and defines a passage through which drink liquid from the internal compartment of the liquid container may be selectively dispensed. The closure is configured to be removably coupled relative to the drink spout in a closed position to selectively restrict dispensing of drink liquid through the passage and to selectively permit dispensing of drink liquid through the passage when removed from the drink spout. The cap assembly may further include a handle. When present, the handle may extend from the base and be configured to selectively retain the closure in a stowed position relative to the handle when the closure is selectively removed from the drink spout.

In some embodiments, the handle defines a closed perimeter, and the closure is received within the closed perimeter when positioned in the stowed position.

Some drink containers according to the present disclosure further include a tether operatively coupling the closure to one of the base of the cap assembly and the liquid container. In some such embodiments, the tether extends through the closed perimeter defined by the handle.

In some embodiments, the drink spout includes an outlet that extends at a non-perpendicular angle to the central and/or longitudinal axis of the drink spout and/or the passage that extends through the drink spout. In some embodiments, the closure has an outer surface that is free from threads and/or which defines a concave and/or smooth lip-receiving surface.

DESCRIPTION

Figure 1:
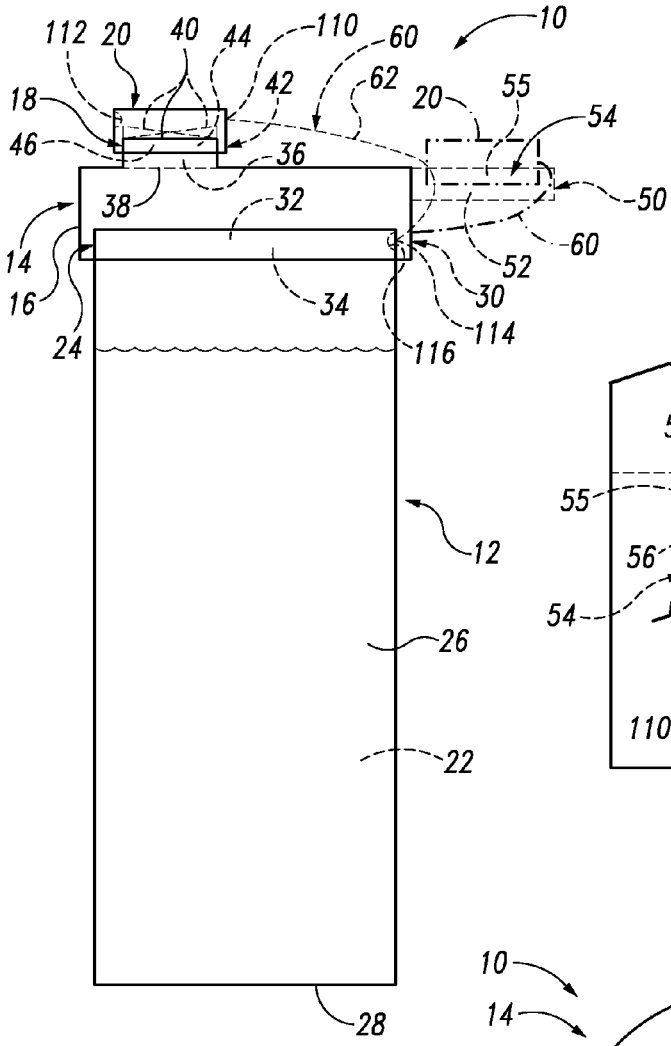
FIG. 1 is a schematic diagram representing illustrative, non-exclusive examples of drink containers with closure retention mechanisms according to the present disclosure.

Drink containers with closure retention mechanisms according to the present disclosure are schematically illustrated in FIG. 1 and are indicated generally at 10. Drink containers 10 according to the present disclosure are designed to receive and selectively dispense to a user a volume of potable drink liquid. Illustrative, non-exclusive examples of drink liquids that may be used in drink containers 10 according to the present disclosure include such potable liquids as water, juice, sports drinks, milk, soft drinks, and the like. Drink containers 10 include at least a liquid container 12 and a cap assembly 14, with the cap assembly including at least a base 16, a drink spout 18, and a closure 20. As discussed in more detail herein, the cap assembly further may include a closure retention mechanism 54 that is configured to releasably receive and retain the closure when the closure is not being used to seal or otherwise obstruct the drink spout.

Liquid containers 12 according to the present disclosure are adapted to receive and hold or otherwise contain up to a predetermined volume of drink liquid 22 for selective consumption by a user, such as when the liquid is dispensed through the drink spout of the cap assembly. Liquid containers 12 may include an open neck 24, through which drink liquid may be selectively poured, or otherwise dispensed, into an internal compartment 26 of the liquid container. Drink liquid may be selectively dispensed from the internal compartment to a user from the neck of the liquid container when the cap assembly is not secured to the neck and/or when the drink spout is not sealed or otherwise obstructed by the closure. It is within the scope of the present disclosure that neck 24 may (but is not required in all embodiments to) define the only opening through which drink liquid may be added to or removed from the liquid container. As discussed in more detail herein, when cap assembly 14 is operatively coupled to the liquid container, this selective dispensing of the drink liquid may be through the drink spout 18 of the cap assembly when the closure 20 is selectively removed from the drink spout. As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

Liquid containers 12 may have any suitable shape and may be formed from any suitable material or combination of materials to hold up to a predetermined volume of drink liquid. Illustrative, non-exclusive examples of suitable sizes, or capacities, of liquid containers 12 (i.e., volume of drink liquid 22 able to be received into a liquid container at one time) include 4 oz., 6 oz., 8 oz., 10 oz., 12 oz., 16 oz., 20 oz., 24 oz., 32 oz., 36 oz., 4-11 oz., 6-15 oz., 10-19 oz., 12-25 oz., 12-36 oz., 15-30 oz., 25-36 oz., 30-45 oz., 35-50 oz., and 10-70 oz. (with these illustrative, non-exclusive examples referring to liquid (fluid) ounces of drink liquid that may be received at one time into an empty liquid container). It is within the scope of the present disclosure that liquid containers having different sizes, including sizes that are smaller than, larger than, or within the illustrative sizes and/or ranges presented above, may be used without departing from the scope of the present disclosure.

An illustrative, non-exclusive example of a material that may be used to construct liquid containers 12 according to the present disclosure includes the TRITAN™ copolyester polymer developed by Eastman Chemical Company. Other illustrative, non-exclusive examples of materials that may be suitable for construction of liquid containers, or portions thereof, according to the present disclosure include polycarbonate, glass, plastic, and/or metal, such as aluminum or stainless steel. Further illustrative, non-exclusive examples are disclosed in U.S. Pat. No. 7,533,783, the disclosure of which is incorporated herein by reference.

Liquid containers 12 may be (but are not required to be) rigid or at least semi-rigid and may include a bottom surface 28 such that a liquid container may be generally self-supporting, or free-standing, when placed on a horizontal surface. In such embodiments, drink containers 10 may be referred to as drink bottles. Liquid containers 12 also optionally may have a double-wall or other insulated construction. In some illustrative, non-exclusive embodiments, a liquid container 12 according to the present disclosure may be constructed of polyethylene or other material that permits the liquid container to have a semi-rigid construction in which the liquid container may be reversibly collapsed during use. Such an illustrative, non-exclusive example may permit opposing portions of the liquid container to be squeezed and/or otherwise urged toward, or even into contact with, each other to reduce the volume of the liquid container and thereby aid in the dispensing of drink liquid 22 therefrom. In such an embodiment, the liquid container may be configured to return automatically to its prior configuration upon reduction of the force and/or pressure that was applied to urge the sides of the liquid container toward each other. Such embodiments may be described as squeeze bottles, as having a squeezable liquid container, and/or as having a resiliently deformable liquid container.

Cap assemblies 14 according to the present disclosure may be adapted to be removably coupled to a liquid container 12 to cover, or otherwise enclose, the neck 24 thereof. When so coupled to a liquid container, a cap assembly 14 restricts drink liquid within the liquid container's internal compartment 26 from being dispensed from the drink container other than through the drink spout 18. When the drink spout is obstructed or otherwise closed or sealed by the closure 20, the cap assembly prevents drink liquid from being dispensed from the liquid container. Accordingly, any drink liquid in the internal compartment of the liquid container is prevented from being dispensed to a user or otherwise removed from the liquid container until either the cap assembly is uncoupled from the liquid container or until the closure is removed from the drink spout.

Although not required in all embodiments, cap assembly 14 typically is removably coupled to liquid container 12, such as to neck 24 thereof, to permit selective and non-destructive removal and replacement (i.e., repeated uncoupling and recoupling) of the cap assembly relative to the liquid container. For example, cap assembly 14 may be uncoupled from the liquid container to permit the liquid container to receive a volume of drink liquid, after which the cap assembly may be recoupled to the liquid container. Accordingly, drink containers 10 according to the present disclosure may include a coupling assembly 30, with the liquid container 12 including coupling structure 32, and with the cap assembly 14 including coupling structure 34, which is adapted to selectively mate with coupling structure 32. In such an embodiment, neck 24 of the liquid container may include coupling structure 32, and base 16 of cap assembly 14 may include coupling structure 34. Coupling assembly 30 may provide a liquid-tight connection between the cap assembly and the liquid container. When such a connection is established between the cap assembly and the liquid container, the cap assembly may restrict liquid from being dispensed from the drink container other than through the drink spout 18. Illustrative, non-exclusive examples of coupling assembly 30 that may be incorporated into drink containers according to the present disclosure include (but are not limited to) threads, snap-fit arrangements, friction-fit arrangements, clasp arrangements, etc.

Drink spout 18 may take any suitable form and may be described as including or defining a passage 36 through which drink liquid from the internal compartment of the liquid container may be selectively dispensed from an inlet 38 to an outlet 40 of the drink spout. Passage 36 additionally or alternatively may be referred to as a dispensing passage 36, a liquid passage 36, and/or an outlet passage 36 of the drink spout and/or of the cap assembly. Similarly, inlet 38 and outlet 40 of the drink spout may additionally or alternatively be referred to as the inlet 38 and the outlet 40 of passage 36.

As used herein, the inlet of passage 36 refers to the portion of the passage that is closest to the internal compartment of the drink container and into which drink liquid first passes from the internal compartment of the drink container, as the drink liquid is dispensed through the passage. Similarly, the outlet of passage 36 refers to the portion of the passage that is farthest away from the internal compartment of the drink container and/or from which the drink liquid last passes from the internal compartment of the drink container as the drink liquid is dispensed from the passage.

The inlet and the outlet of passage 36 are separated by a distance, which additionally or alternatively may be referred to as being, or corresponding to, the length of the passage. It is within the scope of the present disclosure that any suitable passage length may be used, such as lengths that are, or are similar to, the thickness of the material forming the upper surface of the cap assembly, as well as lengths that are 2, 3, 4, 5, 10, or more times this thickness. Additional illustrative, non-exclusive examples of suitable lengths include lengths of at least 1 mm, at least 2 mm, at least 3 mm, at least 4 mm, at least 5 mm, at least 10 mm, at least 15 mm, at least 20 mm, at least 25 mm, at least 30 mm, at least 40 mm, at least 1-10 mm, at least 5-30 mm, or at least 10-50 mm; lengths that are less than 50 mm, less than 40 mm, less than 30 mm, less than 20 mm, less than 15 mm, less than 10 mm, or less than 5 mm, and/or lengths that are bounded by any of the preceding examples. The passage may have any suitable size that is suitable for dispensing drink liquid from the drink container to a user's mouth. As illustrative, non-exclusive examples, the passage may have a cross-sectional area (measured in the plane of the inlet or outlet and/or transverse to the long axis of the passage) that is at least 50 $mm^2$, at least 75 $mm^2$, at least 100 $mm^2$, at least 200 $mm^2$, at least 300 $mm^2$, at least 400 $mm^2$, at least 500 $mm^2$, at least 600 $mm^2$, at least 50-300 $mm^2$, at least 100-500 $mm^2$, or at least 250-750 $mm^2$; an area that is less than 750 $mm^2$, less than 600 $mm^2$, less than 500 $mm^2$, less than 400 $mm^2$, less than 300 $mm^2$, less than 200 $mm^2$, and/or an area that is bounded by any of the preceding examples.

Drink spout 18 may be defined by structure that is separate from the base, such as schematically illustrated in FIG. 1 with a dashed line separating drink spout 18 from base 16. Alternatively, the base and the drink spout may be defined by a unitary structure having a base portion and a drink spout portion. In some embodiments, the drink spout may extend from the base of the cap assembly and may define structure that is configured to be received by a user's mouth. The drink spout may be cylindrical, generally cylindrical, circular, elliptical, or may have any other suitable shape and/or cross-section. Similarly, the outlet 40 to the drink spout may take any suitable shape and form, such as ergonomic shapes that facilitate comfortable engagement with a user's mouth for drinking drink liquid from the drink container.

As schematically optionally illustrated in dashed lines in FIG. 1, the outlet 40 of passage 36 in some embodiments (optionally) may be angled relative to the longitudinal, and or central, axis of drink spout 18 (i.e., at an angle other than a right angle) to facilitate ergonomic drinking of drink liquid. By this it is meant that the outlet defines a plane that extends at an angle other than a right (90°) angle relative to the central, or longitudinal, axis of the drink spout. In some embodiments, the plane defined by the outlet may be angled forward, or toward the front of the drink spout, relative to the longitudinal axis, while in other embodiments, the plane may be angled backwards, or toward the rear of the drink spout, relative to the longitudinal axis. FIG. 1 schematically illustrates both optional configurations in dashed lines. As used herein, the front of the drink spout is the side of the drink spout on which a user typically would be positioned when consuming drink liquid via the drink spout, and the rear of the drink spout would be the opposite side of the drink spout. For example, when consuming liquid via the drink spout, a user's lower lip typically will engage the outside front of the drink spout, and the user's upper lip typically will be positioned at least partially within or above the passage of the drink spout and/or will engage or be above the rear of the drink spout.

The schematic representation of the drink spout in FIG. 1 is generally vertical relative to the base of the cap assembly, that is, with the longitudinal axis of the drink spout being generally co-linear with a longitudinal axis of the base of the cap assembly, with a longitudinal axis of the cap assembly as a whole, and/or with a longitudinal axis of the corresponding liquid container; however, such a configuration is not required. For example, the longitudinal axis of the drink spout may be tilted, or angled, toward the front of the cap assembly or toward the rear of the cap assembly. Moreover, depending on the angle of the drink spout relative to the vertical (or longitudinal axis of the cap assembly base, longitudinal axis of the cap assembly as a whole, and/or longitudinal axis of the corresponding liquid container), in embodiments in which the plane defined by the outlet of the drink spout is angled backwards, or toward the rear of the drink spout, relative to the longitudinal axis of the drink spout, the plane is not necessarily angled backwards relative to the vertical. Instead, the plane may be at a right angle relative to the vertical or even angled forward relative to the vertical. Similarly, in embodiments in which the plane defined by the outlet of the drink spout is angled forward, or toward the front of the drink spout, relative to the longitudinal axis of the drink spout, the plane is not necessarily angled forward relative to the vertical. Instead, the plane may be at a right angle relative to the vertical or even angled backwards relative to the vertical.

Similar to the front of the drink spout, the front of the cap assembly refers to the side of the cap assembly that is generally toward a user during use (i.e., when the user is drinking from the drink spout of the cap assembly) and the rear of the cap assembly refers to the opposite side of the cap assembly, or the side that is generally away from a user during use. In some embodiments, although not required, the drink spout may be positioned toward the front of the cap assembly relative to the base of the cap assembly, and in FIG. 1 the left-most side of the illustrated cap assembly may be referred to as the front of the cap assembly. Also within the scope of the present disclosure, however, are drink spouts that generally are centered on the base of the cap assembly, as well as drink spouts that are positioned toward the rear of the cap assembly and/or toward any side relative to the center of the base of the cap assembly.

Closure 20 is configured to be removably coupled relative to the drink spout to define a closed position of the closure and of the drink spout. An example of such a closed position is schematically illustrated in solid lines in FIG. 1. When in the closed position, the closure restricts, and in many embodiments prevents, dispensing of drink liquid through the passage 36 and the outlet of the drink spout 18. When closure 20 is removed from the drink spout, drink liquid is permitted to be dispensed through the outlet 40 of the drink spout. When the closure is uncoupled from the drink spout, the drink spout may be in an open position, depending upon whether the cap assembly includes a valve or additional mechanism to selectively restrict flow of liquid through the drink spout. Stated differently, closure 20 may be uncoupled from the drink spout to permit dispensing of drink liquid from the liquid container through passage 36 and outlet 40 of the drink spout, after which the closure may be recoupled to the drink spout to seal the passage and outlet of the drink spout. Accordingly, cap assemblies 14 according to the present disclosure may include a coupling assembly 42, with the base 16 and/or the drink spout 18 including coupling structure 44, and with the closure 20 including coupling structure 46, which is adapted to selectively mate with coupling structure 44. Coupling assembly 42 may provide a liquid-tight connection between the closure and the drink spout and/or the base. When such a connection is established between the closure and/or the base of the cap assembly, the closure may prevent liquid from being dispensed from the drink container through the drink spout. Illustrative, non-exclusive examples of coupling assembly 42 that may be incorporated into cap assemblies according to the present disclosure include (but are not limited to) threads, snap-fit arrangements, friction-fit arrangements, clasp arrangements, etc.

In some embodiments, the coupling structure 44 of the drink spout 18 may be on an outer surface, or side, of the drink spout, and the coupling structure 46 of the closure 20 may be on an inner surface of the closure. In such embodiments, the operative sealing of the drink spout when the closure is in its closed position may occur due to operative engagement between the coupling structure 44 and the coupling structure 46. Additionally or alternatively, although not required, the operative sealing of the drink spout may occur due to operative engagement between the drink spout and the closure at the upper edge, or lip, of the drink spout. In some such embodiments, the drink spout, or a portion thereof such as the upper edge thereof, may be constructed of a resilient material that is compressed and forms a seal with the closure when the closure is in the closed position.

Additionally or alternatively, in some embodiments, the coupling structure 44 of the drink spout may be on an inner surface, or side, of the drink spout, and the closure 20 may include structure that extends into the passage 36 of the drink spout when the closure is in the closed position. Such optional structure may be described as, or as including, a plug that extends into the passage when the closure is in the closed position. In some such embodiments, the plug structure optionally may include the coupling structure 46 of the closure on an outer surface, or side, thereof, such that it operatively engages the coupling structure 44 of the drink spout when the closure is operatively positioned into the closed position.

In some embodiments, it is within the scope of the present disclosure that the coupling assembly 42 operatively provides the full extent of sealing of the drink spout when the closure is in the closed position. For example, it is within the scope of the present disclosure that the upper lip of the drink spout does not seal against an inner surface of the closure when the closure is in the closed position, with the sealing of the drink spout instead relying solely on the operative engagement between the coupling structure 44 of the drink spout and the coupling structure 46 of the closure.

Although not required to all embodiments, some cap assemblies 14 according to the present disclosure additionally include a handle 50 that extends from the base 16 of the cap assembly. In FIG. 1, a handle is schematically illustrated as extending generally laterally from a side of the base of the cap assembly; however, it is within the scope of the present disclosure that an optional handle may extend from any portion of the base and at any angle relative to the base and/or relative to the drink spout. When present, handle 50 may, but is not required to, define a closed perimeter, or boundary, 52 through which a lanyard, carabiner, belt, strap, user's finger or fingers, or other structure may extend to hold and/or retain the drink container in a selected position or orientation. The closed perimeter may be defined entirely by the handle or may be defined by the handle and the base of the cap assembly. Regardless, the closed boundary refers to a closed perimeter around an opening through which an object may be inserted and optionally secured around at least a portion of the perimeter.

Figure 2:
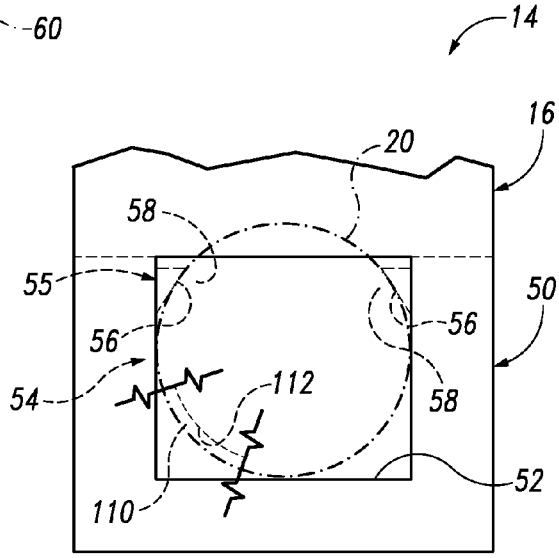
FIG. 2 is a fragmentary schematic diagram representing illustrative, non-exclusive examples of cap assemblies with closure retention mechanisms according to the present disclosure.

FIG. 2 provides a fragmentary plan view of an optional handle 50 relative to the base 16 of a cap assembly 14. As schematically illustrated by dashed lines in FIG. 2, the handle may be defined by structure that is separate from the base; however, it also is within the scope of the present disclosure that the base and the handle may be defined by a unitary structure having a base portion and a handle portion.

In some embodiments, handle 50 may include and/or form a portion of a closure retention mechanism 54 that is configured to selectively retain the closure 20 in a stowed position, as schematically illustrated in dash-dot lines in FIGS. 1-2, when the closure is selectively removed from the drink spout 18 and received by the closure retention mechanism. In other words, in some embodiments of drink containers 10 according to the present disclosure, the closure and/or the handle may be specifically designed and configured to permit a user to stow the closure relative to, and/or within/against a region of, the handle after removal of the closure from the drink spout. Such a configuration may be useful to prevent the closure from being lost, misplaced, or otherwise separated from the drink container while a user is consuming drink liquid therefrom through the drink spout. Additionally or alternatively, such a configuration may be useful to position the closure so as to not interfere with a user's consumption of drink liquid via the drink spout, such as to position the closure away from the user's nose, forehead, etc. Additionally or alternatively, the handle may be described as providing a stowage for the closure to be selectively positioned and retained (i.e., stowed) during periods in which the closure is not operatively coupled to the drink spout to seal or otherwise obstruct the drink spout's passage. Closure retention mechanism 54 additionally or alternatively may be referred to as a closure storage mechanism 54.

The closure retention mechanism 54 may take any suitable form such that it is configured to operatively retain the closure in the stowed position at least temporarily until such time that a user selectively removes the closure from the handle or other portion of the cap assembly that defines the stowed position for the closure. As an illustrative, non-exclusive example, the closure retention mechanism may define at least a portion of the closed perimeter 52 of the handle, such that when the closure is positioned in the stowed position, the closure is positioned at least partially within the closed perimeter, as schematically represented in both of FIGS. 1-2. In some such embodiments, the closure retention mechanism may be configured to retain the closure in the stowed position in a friction-fit arrangement and/or in a snap-fit arrangement. In some embodiments, closure retention mechanism 54 may include any suitable closure retention structure 55 that is configured to receive and selectively retain the closure. As an illustrative, non-exclusive example, the closure retention structure may include at least a pair of spaced-apart, and optionally opposed, tabs 56 that are configured to selectively engage and retain, or otherwise grip, the closure in the stowed position, as schematically and optionally illustrated in FIG. 2. Such optional opposed tabs may be described as extending from the closed perimeter and/or may be described as defining a portion of the closed perimeter. When present, the tabs may be integral to the handle, or otherwise define a unitary structure with the handle; however, it also is within the scope of the present disclosure that the tabs may be separate structure that is not formed as a unitary structure with the body of the handle. In some such embodiments, the tabs may be integral to each other. As an illustrative, non-exclusive example, the closure retention mechanism (and/or the closure retention structure thereof) may include a web or other structure that interconnects the tabs, and in some embodiments, that defines a portion of the closed perimeter of the handle, such as with the handle over-molded over the tabs and corresponding web. The number, size, shape, dimension, and/or relative spacing and/or positioning of tabs 56 and/or other optional closure retention structures 55 may vary without departing from the scope of the present disclosure.

In some embodiments, closure retention structure 55 may include and/or be constructed of a resiliently compressible material, such that the closure retention structure is configured to selectively compress when the closure is being positioned into the stowed position and to thereby selectively retain the closure in the stowed position, such as by an internal bias, or spring, force created by the closure retention structure. Such a configuration additionally or alternatively may be described as providing a friction-fit arrangement between the closure and the handle and/or other portion of the cap assembly that includes the closure retention structure and/or defines the stowed position of the closure.

Additionally or alternatively, in embodiments of closure retention mechanisms 54 that include spaced-apart tabs 56, the closure 20 may be described as having a circumference with a lateral dimension that is greater than a dimension between the tabs. Stated differently, the tabs nominally may be spaced-apart by less than the lateral dimension of the closure. In other words, at least one cross-section of the closure may have a maximum width that is greater than the distance between the spaced-apart tabs, so that when the closure is positioned between and/or otherwise in engagement with the tabs, the tabs engage the closure across the maximum width, such as with the tabs resiliently deflecting, bending, or compressing to accommodate the greater width of the closure. Additionally or alternatively, in some embodiments, the closure may resiliently deflect, bend, or compress to accommodate the narrower width of the tabs. In some embodiments, the closure may be generally circular in cross-section or profile, such as generally defining a cylindrical volume of space, and the lateral dimension of the closure that is engaged by the tabs may correspond to an outer diameter of the closure.

Additionally or alternatively, closure 20 optionally may define corresponding structure 58 that is configured to cooperate with, or otherwise engage, the closure retention mechanism 54, such as to cooperate with the optional tabs 56 or other closure retention structure 55. As illustrative, non-exclusive examples, such corresponding structure 58 may include one or more of a depression, a channel, and/or a concave region that defines part of the outer surface of the closure and that is configured to cooperate with the closure retention mechanism (and/or closure retention structure thereof) to facilitate retention of the closure in the stowed position.

Figure 3:
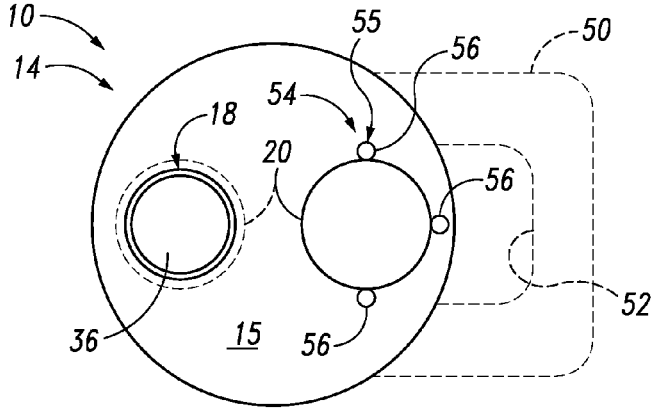
FIG. 3 is a schematic diagram representing additional illustrative, non-exclusive examples of cap assemblies according to the present disclosure.
Figure 4:
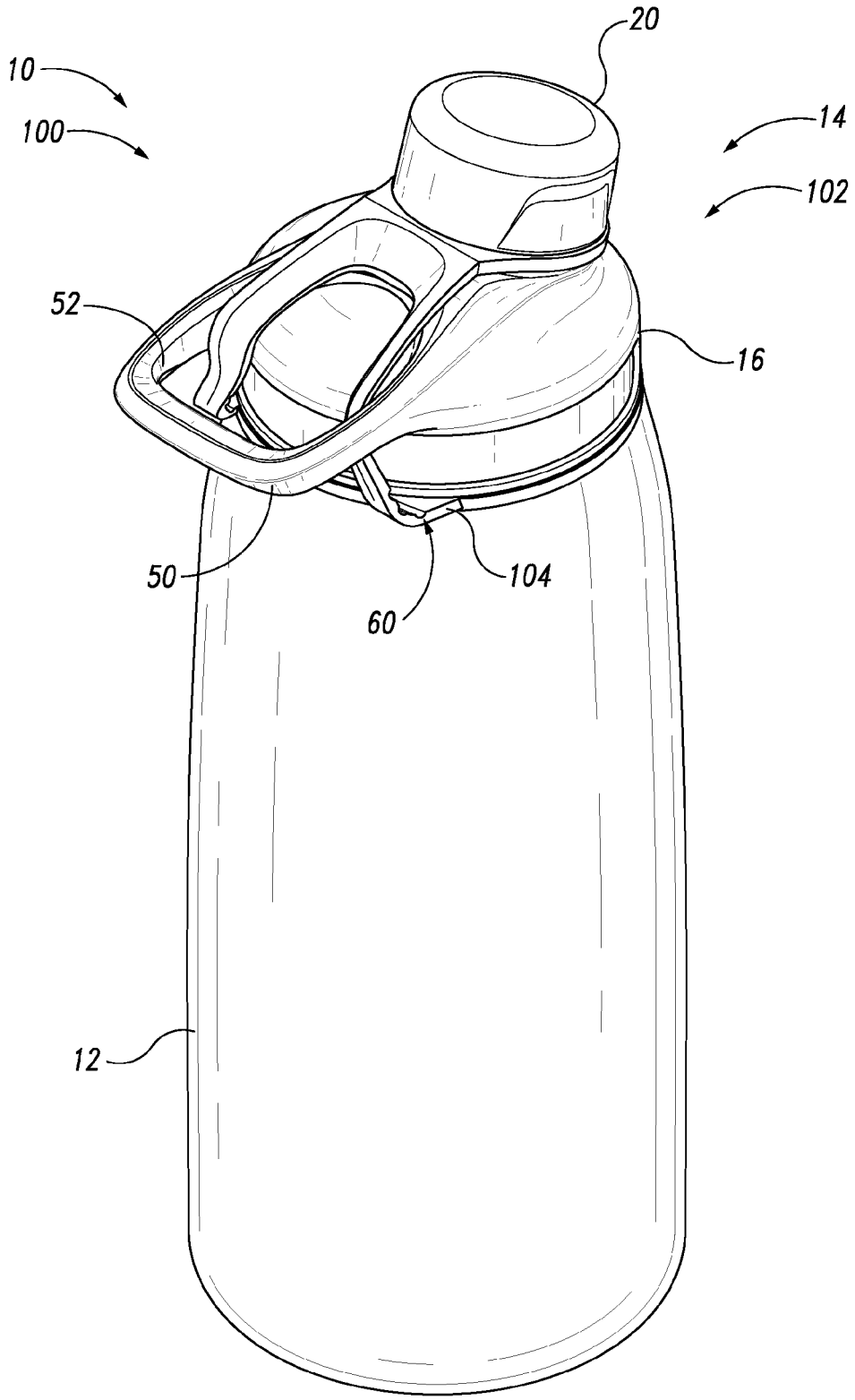
FIG. 4 is a perspective view of an illustrative, non-exclusive example of a drink container according to the present disclosure.
Figure 5:
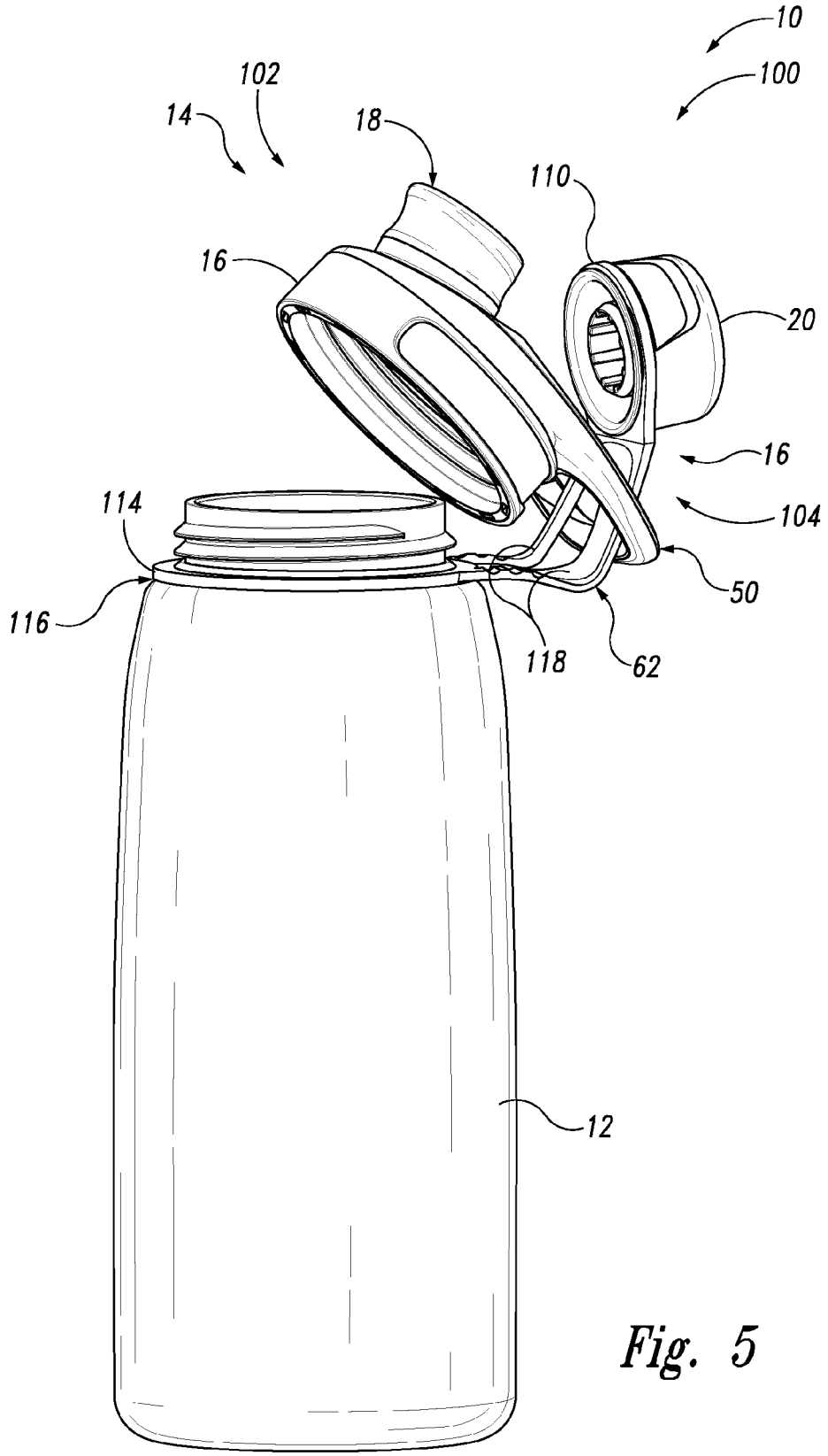
FIG. 5 is a perspective view of the drink container of FIG. 4, shown with the base of the cap assembly removed from the neck of the liquid container and with the closure removed from the drink spout.
Figure 6:
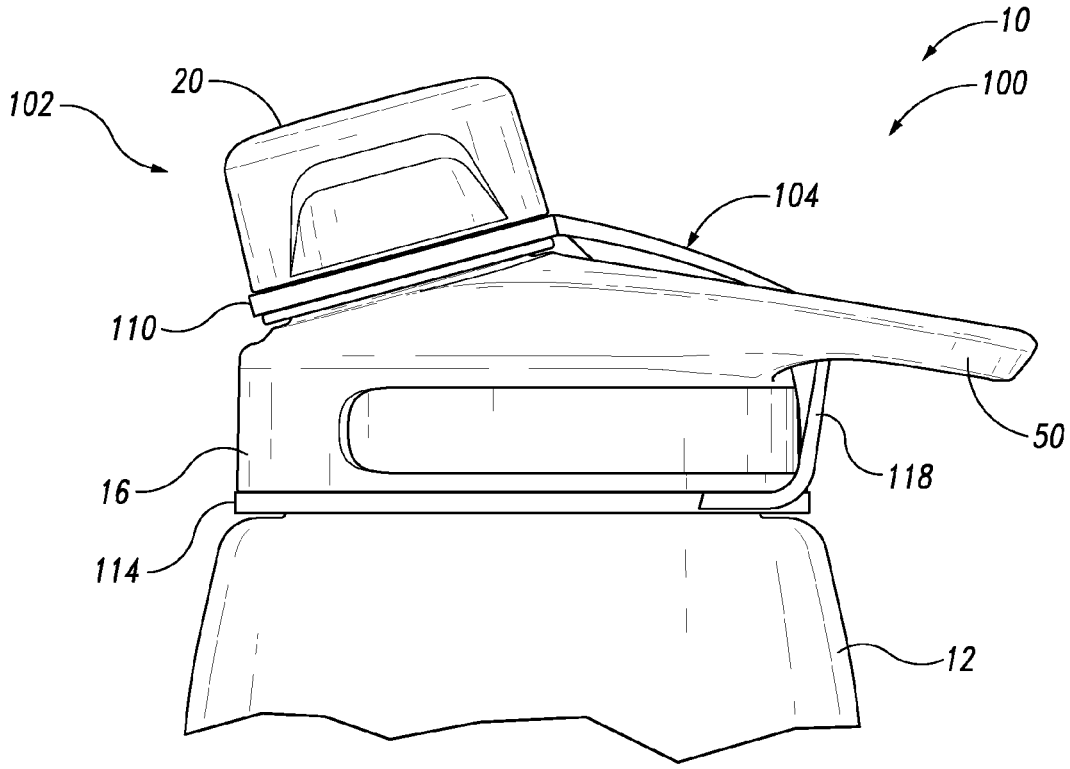
FIG. 6 is a fragmentary side view of the drink container of FIG. 4.

While FIG. 2 and the preceding discussion present examples of closure retention mechanisms 54 that are associated and/or operatively connected with the handle 50 of cap assembly 14, it is within the scope of the present disclosure that a cap assembly 14 may not include a handle 50 and/or that the cap assembly may include a closure retention mechanism 54 that is associated and/or operatively connected with the base and/or other exterior portion of the cap assembly (other than a handle). FIG. 3 schematically represents such optional illustrative, non-exclusive examples of cap assemblies 14. As shown, cap assembly 14 includes an exterior surface 15 through which passage 36 of drink spout 18 extends. A closure retention mechanism 54 also is shown on, projecting from, and/or operatively coupled to, exterior upper surface 15. As illustrated, closure retention mechanism 54 includes a closure retention structure 55 in the form of three spaced-apart tabs 56, although any of the closure retention structures and/or mechanisms disclosed and/or illustrated herein may be utilized. Similarly, a greater or fewer number of tabs 56 may be utilized. Tabs 56 additionally or alternatively may be referred to as ribs, projections, stops, fingers, and/or teeth. Also shown in FIG. 3 is an optional handle 50, which is separate and distinct from the closure retention mechanism and which further optionally may define (alone and/or with the base of the cap assembly) a closed perimeter 52.

Referring back to FIG. 1, some drink containers 10 according to the present disclosure further include a tether 60 that operatively couples the closure 20 to the one or both of the cap assembly 14 and/or the liquid container 12. That is, in some embodiments, the optional tether directly couples the closure to the liquid container. In some embodiments, the optional tether directly couples the closure to the cap assembly. In some embodiments, the optional tether couples the closure to both of the liquid container and the cap assembly. For example, as schematically illustrated in FIG. 1, when a drink container 10 includes a handle 50 that defines a closed perimeter 52, the tether may extend through the closed perimeter from the closure to the liquid container. In some such embodiments where the closure is sized so as to not be permitted to pass through the closed perimeter of the handle, even when the closure is removed from the drink spout 18 and when the base 16 of the cap assembly is decoupled from the neck 24 of the liquid container, the cap assembly 14 is retained on the tether, and thus is indirectly coupled to the liquid container. In other embodiments, the tether may extend through the closed perimeter from the closure to the base of the cap assembly. Other configurations of tethers also are within the scope of the present disclosure and may be incorporated into a drink container 10 according to the present disclosure.

In some embodiments, the optional tether is rotatably coupled to the closure, to the liquid container, and/or to the cap assembly. As an illustrative, non-exclusive example, in embodiments in which the tether is coupled to the liquid container, the tether may define a neck ring, or collar, 114 that operatively extends around the neck of the liquid container. In some such embodiments, the collar may be retained on the liquid container by structure associated with the coupling structure 32, such as threads. Additionally or alternatively, the liquid container may define a circumferential channel, or groove, 116 around or adjacent to the neck of the liquid container, within which the optional neck collar of the tether may be operatively positioned. Similar structure may be used to operatively and rotatably couple the tether to the cap assembly. Additionally or alternatively, the tether may define a closure ring, or collar, 110 that operatively extends around, and that is operatively retained on, the closure. For example, the closure may define a circumferential channel, or groove, 112 around the outer surface of the closure, within which the optional closure collar of the tether may be operatively positioned. This optional configuration is schematically and optionally illustrated in FIG. 2. Optional tethers 60 according to the present disclosure may be configured in any suitable manner from any suitable material and typically include at least a flexible body 62 that extends between the closure and the liquid container and/or the base of the cap assembly, and optionally through the closed perimeter of an optional handle 50.

In some embodiments of cap assemblies 14 that include an optional closure retention mechanism 54 and an optional tether 60, the closure retention mechanism may be configured to engage the tether to operatively retain the closure in its stowed position, such as with the optional closure retention structure 55 in the form of at least a pair of spaced-apart tabs 56. For example, in embodiments in which the tether includes an optional closure collar 110 that extends around a circumferential channel, or groove, 112 defined by the closure, the closure collar may be engaged by the closure retention mechanism when a user selectively positions the closure in its stowed position. In some such embodiments, the closure retention mechanism may be configured to retain the closure in the stowed position with the tether, such as the closure collar 110 thereof, and the closure retention mechanism being in a friction-fit arrangement and/or in a snap-fit arrangement with each other.

Additionally or alternatively, in embodiments of closure retention mechanisms 54 that include spaced-apart tabs 56, the closure collar 110 portion of the tether may be described as having a circumference with a lateral dimension that is greater than a dimension between the tabs. Stated differently, the tabs may be spaced apart by less than the lateral dimension of the closure collar. In other words, at least one cross-section of the closure collar may have a maximum width that is greater than the distance between the tabs, so that when the closure collar is positioned between the tabs, the tabs engage the closure collar across the maximum width. In such a configuration, the tabs may deflect or otherwise deform (resiliently), and/or portions of the tabs and/or closure collar may compress, to accommodate the closure collar's width. In some embodiments, the closure collar may be generally circular, and the lateral dimension of the closure collar that is engaged by the tabs may correspond to an outer diameter of the closure collar.

Additionally or alternatively, the closure retention mechanism 54 may be configured to engage both of the tether and the closure to operatively retain the closure in its stowed configuration.

Also within the scope of the present disclosure are cap assemblies 14 that are provided without an associated liquid container. For example, a cap assembly may be provided as a replacement and/or alternative cap assembly for a liquid container. Additionally or alternatively, a cap assembly may be configured to be used with a generic liquid container that is not necessarily specifically configured, sold, and/or intended to be used with a cap assembly 14 according to the present disclosure. In some embodiments of cap assemblies, an optional tether may be described as a component of the cap assembly.

Turning now to FIGS. 4-13, an illustrative non-exclusive example of a drink container 10 and component parts thereof are illustrated, with the example drink container identified and referred to herein as drink container 100. The reference numerals from the schematic illustrations of FIGS. 1-3 may be used in FIGS. 4-13 to designate corresponding parts; however, the example of FIGS. 4-13 is non-exclusive and does not limit drink containers 10 to the illustrated embodiment of FIGS. 4-13. That is, drink containers 10 are not limited to the specific embodiment illustrated in FIGS. 4-13, and drink containers according to the present disclosure may incorporate any number of the various aspects, configurations, characteristics, properties, etc. that are illustrated in and discussed with reference to the schematic representations of FIGS. 1-3 and/or the embodiment of FIGS. 4-13, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to the example of FIGS. 4-13; however, it is within the scope of the present disclosure that the previously discussed features, variants, etc. may be utilized with such examples, or variations thereon.

Drink container 100 is an example of a drink container 10 that includes a liquid container 12, a cap assembly 14 (identified herein as cap assembly 102), and a tether 60 (identified herein as tether 104). Moreover, drink container 100 is an example of a drink container 10 having a closure 20 that may be operatively and selectively positioned between a closed position, illustrated in FIGS. 4 and 6-8, and a stowed position, illustrated in FIGS. 10-13.

Cap assembly 102 includes a base 16 and a handle 50 that defines a closed perimeter 52. Tether 104 is operatively coupled to the closure 20 and extends through the closed perimeter of the handle to be operatively coupled to the neck of the liquid container, as perhaps best seen in FIG. 5 with the base of the cap assembly operatively uncoupled from the neck of the liquid container and with the closure operatively uncoupled from the drink spout.

Figure 8:
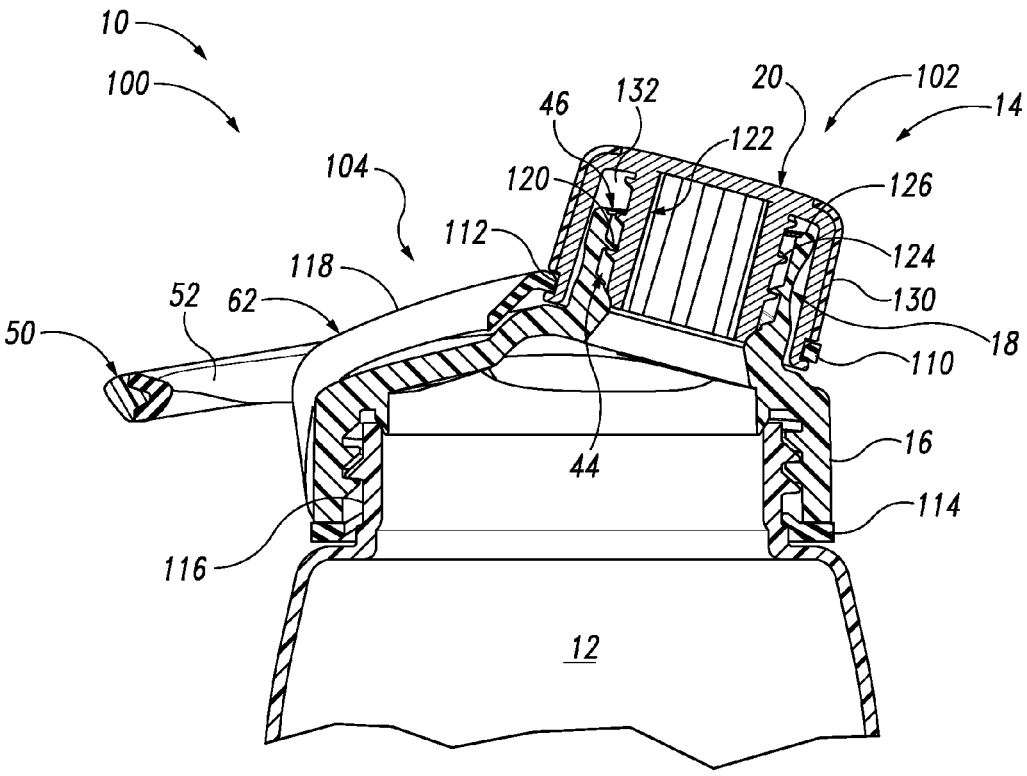
FIG. 8 is a fragmentary cross-sectional side view of the drink container of FIG. 4.
Figure 9:
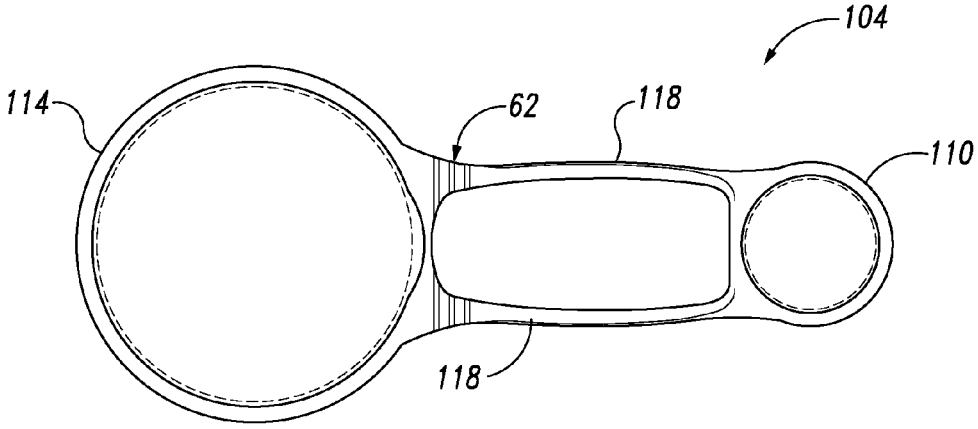
FIG. 9 is a plan view of the tether of the drink container of FIG. 4.
Figure 10:
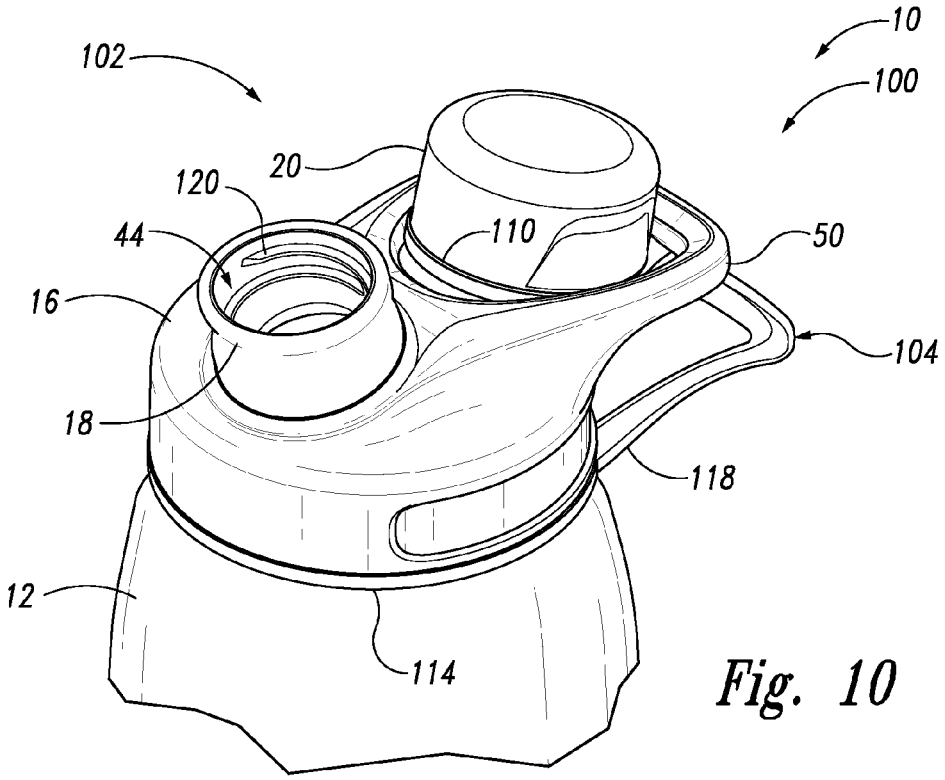
FIG. 10 is a fragmentary perspective view of the drink container of FIG. 4, with the closure in the stowed position.

Tether 104 of drink container 100 includes a tether body 62, a closure collar 110 that extends around a channel 112 defined by the closure, and a neck collar 114 that extends around a channel 116 defined by the neck of the liquid container, as perhaps best seen in the cross-sectional view of FIG. 8. With particular reference to FIG. 9, however, the tether body includes a pair of webs 118 interconnecting the closure collar 110 and the neck collar 114. Although not required, as optionally and schematically represented by the dashed inner circles in FIG. 12, the closure collar and/or the neck collar each may include an inner ring that is constructed of a (relatively) hard, or rigid, plastic, while the tether body and the webs thereof may be constructed of a (relatively) flexible elastomer that is over-molded over the inner rings. As a result, the hard plastic of the collars may facilitate rotation, or spinning, of the respective collars relative to the neck and the closure. Additionally or alternatively in such optional embodiments, the tether body and/or webs may be described as being flexible and/or resilient, and the closure collar and neck collar may be described as being less flexible and/or less resilient than the tether body and/or webs.

Referring back to FIG. 7, the webs 118 of the tether body optionally may be sized and/or otherwise constructed or supported to engage opposed lateral sides of the closed perimeter 52 of the handle 50 when the closure 20 is in its closed position relative to the drink spout.

With particular reference to the cross-sectional view of FIG. 8, the drink spout 18 of cap assembly 102 is an example of a drink spout that includes coupling structure 44 in the form of internal threads 120 positioned on the inner surface of the drink spout's passage. The closure 20 of cap assembly 102 is an example of a closure that includes a plug structure 122 that is configured to extend into the passage of the drink spout when the closure is positioned to its closed position, and with the plug structure having external threads 124 configured to mate with the internal threads 120 of the drink spout. Cap assembly 102 is an example of a cap assembly in which the operative sealing of the drink spout is accomplished between the internal threads 120 of the drink spout and the external threads 124 of the closure, and the upper lip 126 of the drink spout does not engage the closure when the closure is in its closed position. In fact, the closure and the drink spout collectively define a void 132 between the closure and the upper lip 126 of the drink spout.

Moreover, the closure 20 of cap assembly 102 may be described as having a dust cover, or protective sleeve, 130 that extends around the drink spout and that protects the drink spout from contamination when the closure is in the closed position. In other words, the protective sleeve may restrict dirt and grime from contacting the outer surface of the drink spout, which a user engages with his/her mouth during consumption of drink liquid, but the protective sleeve does not include, or define, the coupling structure 44 of the drink spout. Rather, the separate plug structure 122 having coupling structure 46 in the form of external threads 124 operatively serves to seal the drink spout when in operative engagement with the internal threads 120 of the drink spout.

Figure 7:
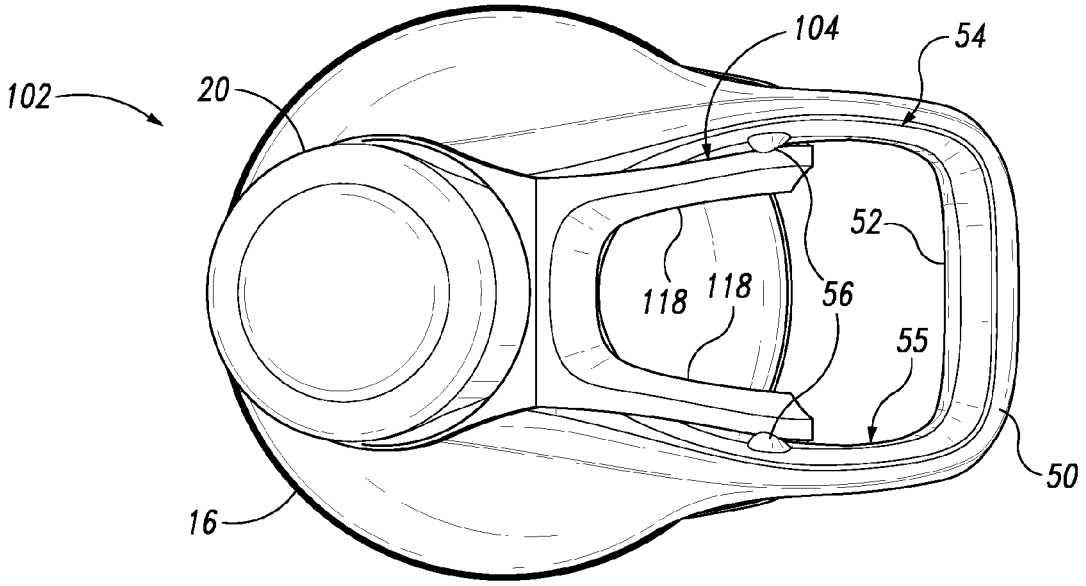
FIG. 7 is a top view of the cap assembly and the tether of the drink container of FIG. 4.

As perhaps best seen in the top view of FIG. 7, the handle of cap assembly 102 includes a closure retention mechanism 54 that includes closure retention structure 55 in the form of spaced-apart tabs 56, which in the depicted example may be described as being opposed tabs 56. Furthermore, in this example, the tabs additionally or alternatively may be described generally as vertically oriented half-cylindrical protrusions extending inward from the closed perimeter of the handle and adjacent to the base of the cap assembly. The closure 20 of cap assembly 102 is generally circular in cross-section and has a diameter that is greater than the distance between the tabs 56, at least when the closure is not operatively positioned in the stowed position. When the closure is operatively positioned within the closed perimeter of the handle into its stowed position as illustrated in FIGS. 10-13, however, such that the tabs engage opposing sides of the closure, the lower portion of the closure is compressed slightly to have a slightly non-circular profile. That is, the closure is slightly compressed between the protrusions, resulting in a friction-fit between the closure and the closed perimeter of the handle. Moreover, the spaced-apart tabs are positioned past center of the of the diameter of the closure when the closure is operatively and fully positioned in its stowed position within the closed perimeter of the handle, further retaining the closure in is stowed position in a friction-fit arrangement and restricting removal of the closure until a user selectively chooses to remove the closure from the stowed position. More specifically, when the closure is fully positioned in its stowed positioned, the closure not only engages the tabs, but also engages the inside edge of the distal portion of the handle so that the closure is secured between the tabs and the inside edge of the handle, as perhaps best seen in FIG. 12.

Figure 11:
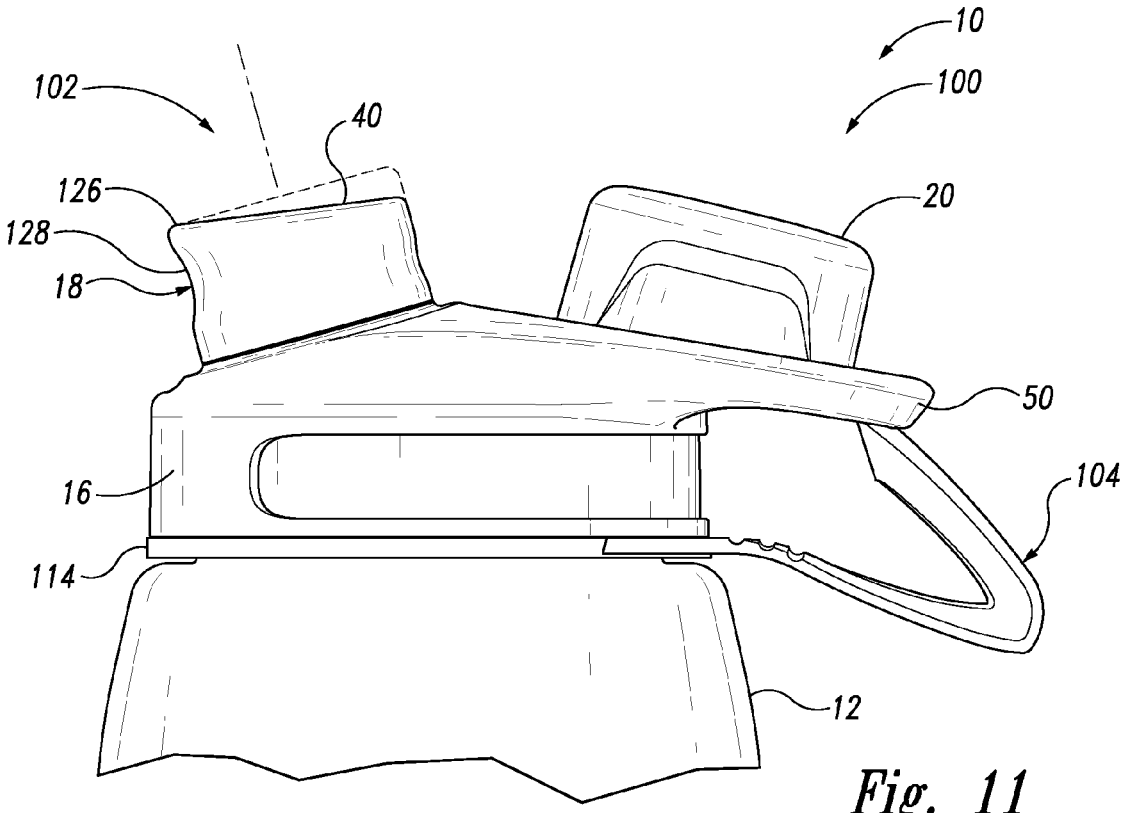
FIG. 11 is a fragmentary side view of the drink container of FIG. 4, with the closure in the stowed position.
Figure 12:
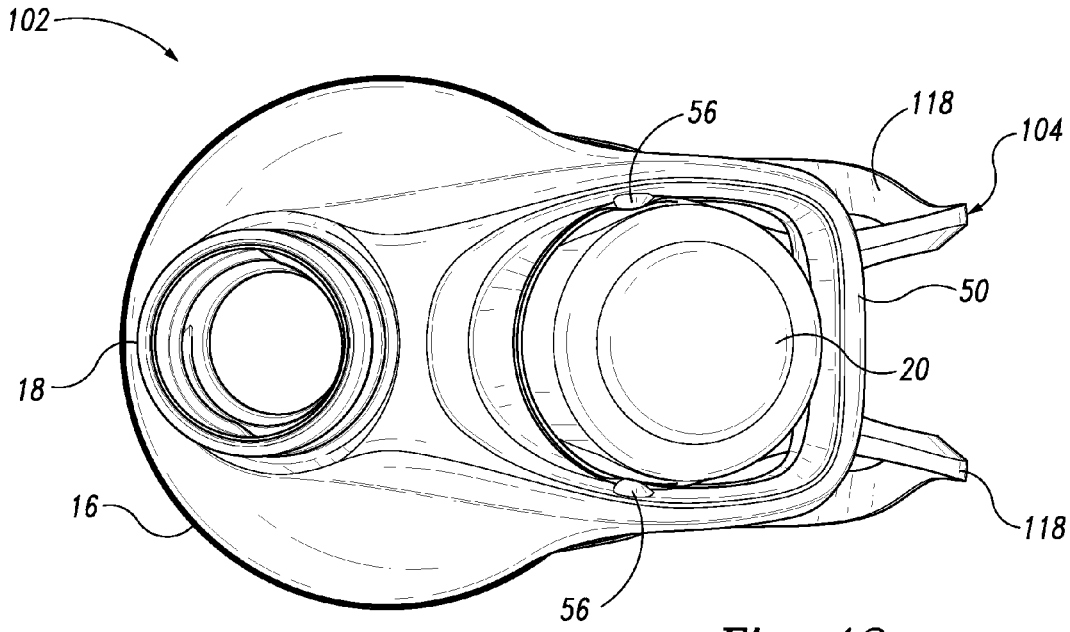
FIG. 12 is a top view of the cap assembly and the tether of the drink container of FIG. 4, with the closure in the stowed position.
Figure 13:
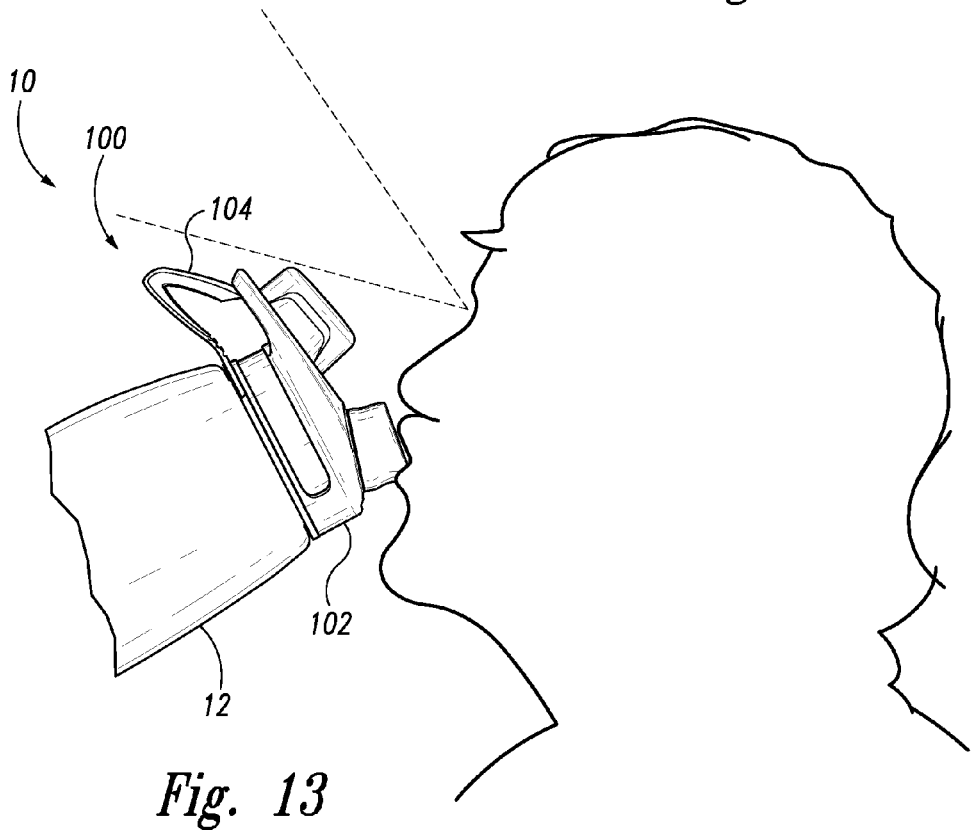
FIG. 13 is a fragmentary side view of the drink container of FIG. 4 showing a user consuming liquid from the drink container.

As best seen in FIG. 11, the drink spout 18 of cap assembly 102 is an example of a drink spout that includes an outlet 40 that is angled relative to the drink spout at an angle other than a right angle, as schematically represented relative to the dashed outline of an optional drink spout having an outlet that is at a right angle relative to the central/longitudinal axis of the drink spout, which is indicated with a dash-dot line. More specifically, the plane defined by the outlet may be described as being angled rearward relative to the longitudinal axis of the drink spout, yet forward relative to the vertical. Such a configuration permits for ergonomic drinking of drink liquid, as illustrated in FIG. 13. As also shown in FIG. 11, the front exterior surface of the drink spout (i.e., the region below upper lip 126 that is engaged by a user's lower lip when the user drinks from the drink spout) includes a smooth and/or concave lip-receiving surface 128 that is free of threads, notches, grooves, or other discontinuities that may define a leak path along the surface while a user is drinking from the drink spout.

As illustrated in FIG. 13, the angle of the handle relative to the base of cap assembly 102, together with the corresponding placement of the closure in its stowed position, facilitates ergonomic drinking of drink liquid without the handle and closure engaging the user's face (such as the user's nose) or even blocking a significant portion of the user's line of sight while consuming drink liquid.

Illustrative, non-exclusive examples of drink containers and cap assemblies according to the present disclosure are described in the following enumerated paragraphs:

A. A drink container, comprising:

a liquid container having a neck with an opening and having an internal compartment sized to hold a volume of potable drink liquid; and a cap assembly removably coupled to the liquid container, the cap assembly comprising:

- a base removably coupled to the neck of the liquid container;
- a drink spout extending from the base and defining a passage through which drink liquid from the internal compartment of the liquid container may be selectively dispensed; and
- a closure configured to be removably coupled relative to the drink spout in a closed position to selectively restrict dispensing of drink liquid through the passage and to selectively permit dispensing of drink liquid through the passage when removed from the drink spout.

A1. The drink container of paragraph A, wherein the cap assembly further comprises a closure retention mechanism configured to selectively retain the closure in a stowed position relative to the base when the closure is selectively removed from the drink spout and received by the closure retention mechanism.

A1.1. The drink container of paragraph A1, wherein the closure retention mechanism is configured to retain the closure in the stowed position in a friction-fit arrangement and/or a snap-fit arrangement.

A1.2. The drink container of any of paragraphs A1-A1.1, wherein the closure retention mechanism includes spaced-apart, and optionally opposed, tabs configured to grip and retain the closure in the stowed position.

A1.3. The drink container of any of paragraphs A1-A1.2, wherein the closure retention mechanism is constructed of a resiliently compressible material, and wherein the closure retention mechanism is configured to selectively compress when the closure is entering the stowed position and to selectively retain the closure in the stowed position.

A1.4. The drink container of any of paragraphs A1-A1.3, wherein the closure is constructed of a resilient material, and wherein the closure retention mechanism is configured to selectively compress the closure when the closure is entering the stowed position and/or when the closure is in the stowed position.

A1.5. The drink container of any of paragraphs A1-A1.4, wherein the closure has a circumference with a lateral dimension, wherein the closure retention mechanism includes tabs that are spaced-apart by less than the lateral dimension of the closure.

A1.6. The drink container of any of paragraphs A1-A1.5, wherein the closure is generally circular, and optionally when depending from paragraph A1.5, wherein the lateral dimension is a diameter of the closure.

A1.7. The drink container of any of paragraphs A1-A1.6, wherein the closure defines one or more of a depression, a channel, and/or a concave region defined on an outer surface of the closure and configured to cooperate with the closure retention mechanism when the closure is in the stowed position.

A2. The drink container of any of paragraphs A-A1.7, wherein the cap assembly further comprises:

a handle extending from the base, optionally wherein the handle is fixed to the base.

A2.1. The drink container of paragraph A2, wherein the handle (optionally collectively with the base) defines a closed perimeter, optionally wherein the closed perimeter defines a plane that is transverse or lateral to a longitudinal axis of the liquid container.

A2.1.1. The drink container of paragraph A2.1, wherein the closed perimeter is sized to selectively receive and retain the closure in a stowed position relative to the handle when the closure is selectively removed from the drink spout.

A2.2. The drink container of any of paragraphs A2-A2.1.1 when depending from paragraph A1, wherein the handle includes the closure retention mechanism, and wherein the closure retention mechanism is configured to selectively retain the closure in the stowed position relative to the handle when the closure is selectively removed from the drink spout and received by the closure retention mechanism.

A2.2.1. The drink container of paragraph A2.2 when depending from paragraph A2.1, wherein the closure retention mechanism defines at least a portion of the closed perimeter.

A2.2.2. The drink container of any of paragraphs A2.2-A2.2.1, wherein in the stowed position, the closure is positioned at least partially within the closed perimeter.

A3. The drink container of any of paragraphs A-A2.2.2, further comprising:

a tether operatively coupling the closure to the base of the cap assembly and/or the liquid container.

A3.1. The drink container of paragraph A3 when depending from paragraph A2.1, wherein the tether extends through the closed perimeter of the handle.

A3.2. The drink container of any of paragraphs A3-A3.1, wherein the tether is rotatably coupled to the closure.

A3.3. The drink container of any of paragraphs A3-A3.2, wherein the tether is rotatably coupled to the liquid container and/or the base of the cap assembly.

A3.4. The drink container of any of paragraphs A3-A3.3, wherein the tether includes:

a tether body, optionally constructed of a relatively flexible material;

a closure collar coupled to the tether body and extending around and engaged with the closure; and a neck collar coupled to the tether body and extending around and engaged with the base of the cap assembly or the neck of the liquid container.

A3.4.1. The drink container of paragraph A3.4, wherein the closure collar and the neck collar are constructed of a relatively rigid material.

A3.4.2. The drink container of any of paragraphs A3.4-A3.4.1, wherein the tether body includes a pair of webs that interconnect the closure collar and the neck collar.

A3.4.2.1. The drink container of paragraph A3.4.2 when depending from paragraph A2.1, wherein the closed perimeter has opposed lateral sides, and wherein the pair of webs extend along and/or adjacent to, and optionally engage, the opposed lateral sides when the closure is in the closed position.

A3.4.3. The drink container of any of paragraphs A3.4-A3.4.2.1 when depending from paragraph A1, wherein the closure retention mechanism is configured to selectively engage the closure collar when the closure is positioned in the stowed position.

A3.4.3.1. The drink container of paragraph A3.4.3, wherein the closure collar has a circumference with a lateral dimension, wherein the closure retention mechanism includes tabs that are spaced-apart by less than the lateral dimension of the closure collar, optionally wherein the closure collar is generally circular.

A4. The drink container of any of paragraphs A-A3.4.3.1, wherein the drink spout defines an outlet and a longitudinal axis, wherein the outlet defines a plane that is angled backwards relative to the longitudinal axis of the drink spout.

A5. The drink container of any of paragraphs A-A4, wherein the drink spout defines an outlet, wherein the liquid container defines a longitudinal axis, and wherein the outlet defines a plane that is angled forward relative to the longitudinal axis of the liquid container when the cap assembly is operatively coupled to the liquid container.

A6. The drink container of any of paragraphs A-A5, wherein the drink spout includes internal coupling structure (optionally threads), wherein the closure includes plug structure that is configured to extend within the passage when the closure is in the closed position, and wherein the plug structure includes external coupling structure (optionally threads) that is configured to operatively mate with the internal coupling structure of the drink spout when the closure is in the closed position.

A7. The drink container of any of paragraphs A-A6, wherein the drink spout defines an upper lip, and wherein the upper lip does not engage the closure when the closure is in the closed position.

A7.1. The drink container of paragraph A7, wherein the closure and the drink spout define a void between the closure and the drink spout above the upper lip when the closure is in the closed position.

A7.2. The drink container of any of paragraphs A-A7.1, where the drink spout includes a lip-receiving exterior surface that is free of threads.

B. A cap assembly, comprising the cap assembly as described in any of paragraphs A-A7.2, separate from a liquid container, wherein the cap assembly is configured to be removably coupled to a liquid container.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A drink container, comprising:

a liquid container having a neck with an opening and having an internal compartment sized to hold a volume of potable drink liquid; and a cap assembly removably coupled to the liquid container, the cap assembly comprising:

a base removably coupled to the neck of the liquid container;

a drink spout extending from the base and defining a passage through which drink liquid from the internal compartment of the liquid container may be selectively dispensed;

a closure configured to be removably coupled relative to the drink spout in a closed position to selectively restrict dispensing of drink liquid through the passage and to selectively permit dispensing of drink liquid through the passage when removed from the drink spout; and a handle extending from the base and defining a closed perimeter, wherein the closed perimeter is sized to selectively receive and retain the closure in a stowed position relative to the handle in a friction-fit arrangement when the closure is selectively removed from the drink spout; and a tether operatively coupling the closure to the liquid container, wherein the tether extends through the closed perimeter of the handle.

2. The drink container of claim 1, wherein the tether includes:

a closure collar extending around and rotatably engaged with the closure;

a neck collar extending around and rotatably engaged with the neck of the liquid container; and a pair of webs that interconnect the closure collar and the neck collar.

3. The drink container of claim 2, wherein the closed perimeter has opposed lateral sides, and wherein the pair of webs extend adjacent to the opposed lateral sides when the closure is in the closed position.

4. The drink container of claim 1, wherein the closed perimeter defines a plane that is transverse to a longitudinal axis of the liquid container.

5. A drink container, comprising:

a liquid container having a neck with an opening and having an internal compartment sized to hold a volume of potable drink liquid; and a cap assembly removably coupled to the liquid container, the cap assembly comprising:

a base removably coupled to the neck of the liquid container;

a drink spout extending from the base and defining a passage through which drink liquid from the internal compartment of the liquid container may be selectively dispensed;

a closure configured to be removably coupled relative to the drink spout in a closed position to selectively restrict dispensing of drink liquid through the passage and to selectively permit dispensing of drink liquid through the passage when removed from the drink spout;

a handle extending from the base, wherein the handle includes a closure retention mechanism configured to selectively retain the closure in a stowed position relative to the handle when the closure is selectively removed from the drink spout and received by the closure retention mechanism.

6. The drink container of claim 5, wherein the handle defines a closed perimeter, and wherein the closure retention mechanism defines at least a portion of the closed perimeter.

7. The drink container of claim 5, wherein the handle defines a closed perimeter, and wherein in the stowed position, the closure is positioned at least partially within the closed perimeter.

8. The drink container of claim 7, wherein the closure retention mechanism includes spaced-apart tabs configured to grip and retain the closure in the stowed position.

9. The drink container of claim 8, wherein the closure has a circumference with a lateral dimension, wherein the spaced-apart tabs are spaced-apart by less than the lateral dimension of the closure.

10. The drink container of claim 7, wherein the closure is constructed of a resilient material, and wherein the closure retention mechanism is configured to selectively compress the closure when the closure is in the stowed position and retain the closure in the stowed position in a friction-fit arrangement.

11. The drink container of claim 5, further comprising:

a tether operatively coupling the closure to one of the base of the cap assembly and the liquid container;

wherein the handle defines a closed perimeter, and wherein the tether extends through the closed perimeter of the handle.

12. The drink container of claim 11, wherein the tether includes:

a closure collar extending around and rotatably engaged with the closure;

a neck collar extending around and rotatably engaged with the neck of the liquid container; and a pair of webs that interconnect the closure collar and the neck collar.

13. The drink container of claim 12, wherein the closed perimeter has opposed lateral sides, and wherein the pair of webs extend adjacent to the opposed lateral sides when the closure is in the closed position.

14. The drink container of claim 12, wherein the closure retention mechanism is configured to selectively engage the closure collar when the closure is positioned in the stowed position.

15. The drink container of claim 5, wherein the drink spout defines an outlet, wherein the liquid container defines a longitudinal axis, and wherein the outlet defines a plane that is angled forward relative to the longitudinal axis of the liquid container when the cap assembly is operatively coupled to the liquid container.

16. The drink container of claim 5, wherein the drink spout includes an internal coupling structure, wherein the closure includes a plug structure that is configured to extend within the passage when the closure is in the closed position, and wherein the plug structure includes an external coupling structure that is configured to operatively mate with the internal coupling structure of the drink spout when the closure is in the closed position.

17. The drink container of claim 5, wherein the drink spout defines an upper lip, and wherein the upper lip does not engage the closure when the closure is in the closed position.

18. The drink container of claim 17, wherein the closure and the drink spout define a void between the closure and the drink spout above the upper lip when the closure is in the closed position.

19. A cap assembly for use with a liquid container having a neck with an opening and having an internal compartment sized to hold a volume of potable drink liquid, the cap assembly comprising:

a base configured to be removably coupled to the neck of the liquid container;

a drink spout extending from the base and defining a passage through which drink liquid from the internal compartment of the liquid container may be selectively dispensed when the cap assembly is operatively coupled to the liquid container;

a closure configured to be removably coupled relative to the drink spout in a closed position to selectively restrict dispensing of liquid through the passage and to selectively permit dispensing of liquid through the passage when removed from the drink spout;

a handle extending from the base, wherein the handle includes a closure retention mechanism configured to selectively retain the closure in a stowed position relative to the handle when the closure is selectively removed from the drink spout and received by the closure retention mechanism.

20. The cap assembly of claim 19, wherein the handle defines a closed perimeter, the cap assembly further comprising:

a tether extending through the closed perimeter and operatively coupled to the closure on one end of the tether and configured to be operatively coupled to the neck of the liquid container on an opposite end of the tether.

to be operatively coupled to the neck of a liquid container on an opposite end of the tether.

* * * * *

UNITED STATES PATENT AND TRADEMARK OFFICE

CERTIFICATE OF CORRECTION

PATENT NO. : 8,905,252 B2
APPLICATION NO. : 14/199817
DATED : December 9, 2014
INVENTOR(S) : Matthew W. Latham and Derek Gavin Sullivan It is certified that error appears in the above-identified patent and that said Letters Patent is hereby corrected as shown below:

In the Claims:

Claim 20, Column 20, Lines 45-46, please delete "to be operatively coupled to the neck of a liquid container on an opposite end of the tether."

Signed and Sealed this
Ninth Day of June, 2015

Michelle K. Lee

Michelle K. Lee
*Director of the United States Patent and Trademark Office*